US011542830B2

(12) United States Patent
Yang

(10) Patent No.: US 11,542,830 B2
(45) Date of Patent: Jan. 3, 2023

(54) VIBRATION DAMPER, EXHAUST DIFFUSER SYSTEM, AND GAS TURBINE INCLUDING SAME

(71) Applicant: DOOSAN ENERBILITY CO., LTD, Changwon-si (KR)

(72) Inventor: Young Chan Yang, Changwon (KR)

(73) Assignee: DOOSAN ENERBILITY CO., LTD., Changwon (KR)

( * ) Notice: Subject to any disclaimer, the term of this patent is extended or adjusted under 35 U.S.C. 154(b) by 0 days.

(21) Appl. No.: 17/372,596

(22) Filed: Jul. 12, 2021

(65) Prior Publication Data

US 2022/0082028 A1 Mar. 17, 2022

(30) Foreign Application Priority Data

Sep. 11, 2020 (KR) ..... 10-2020-0117167
Oct. 30, 2020 (KR) ..... 10-2020-0143684

(51) Int. Cl.
*F01D 25/04* (2006.01)
*F01D 25/16* (2006.01)

(52) U.S. Cl.
CPC ..... *F01D 25/04* (2013.01); *F01D 25/164* (2013.01); *F05D 2220/32* (2013.01); *F05D 2260/96* (2013.01)

(58) Field of Classification Search
CPC ..... F01D 25/04; F01D 25/164; F01D 25/24; F01D 25/26; F01D 25/265; F01D 25/28; F05D 2260/96
See application file for complete search history.

(56) References Cited

U.S. PATENT DOCUMENTS 6,971,842 B2 * 12/2005 Luniewski ..... F01D 25/30 415/214.1
7,797,922 B2 * 9/2010 Eleftheriou ..... F01D 25/24 415/208.4

(Continued)

FOREIGN PATENT DOCUMENTS

CN 102620313 A 8/2012
JP 2008064043 A 3/2008

(Continued)

OTHER PUBLICATIONS

Written Decision on Registration for KR 10-2020-0117167 Jan. 27, 2022 (Year: 2022).*

(Continued)

*Primary Examiner* — Topaz L. Elliott
(74) *Attorney, Agent, or Firm* — Harvest IP Law LLP

(57) ABSTRACT

A vibration damper capable of damping vibrations occurring from a turbine casing, an exhaust diffuser system including the vibration damper, and a gas turbine including the exhaust diffuser system are provided. The vibration damper installed on an outer casing of a gas turbine to damp vibrations generated in the gas turbine, the vibration damper includes a reinforcing support part including a plurality of reinforcing plates, a first flange coupled to both longitudinal ends of the reinforcing support part and fixed to a protruding support protruding from the outer casing, and a second flange disposed between the plurality of reinforcing plates to connect the plurality of reinforcing plates, wherein each of the plurality of reinforcing plates is erected and installed on an outer circumferential surface of the outer casing.

20 Claims, 9 Drawing Sheets

(56) References Cited

U.S. PATENT DOCUMENTS

| | | | | |
|---|---|---|---|---|
| 8,172,528 | B2 * | 5/2012 | Kawakami | F01D 25/26 415/220 |
| 9,297,438 | B2 * | 3/2016 | Meacham | F16F 15/131 |
| 2005/0063821 | A1 * | 3/2005 | Luniewski | F01D 25/24 415/211.2 |
| 2005/0116552 | A1 * | 6/2005 | Safonov | H02K 7/04 267/136 |
| 2007/0241257 | A1 * | 10/2007 | Eleftheriou | F02K 3/06 248/554 |
| 2009/0220337 | A1 * | 9/2009 | Kawakami | F01D 25/28 415/220 |
| 2012/0039709 | A1 | 2/2012 | Rauch | |
| 2013/0186105 | A1 * | 7/2013 | Meacham | F16F 15/131 60/797 |
| 2015/0128609 | A1 * | 5/2015 | Piersail | F02C 7/20 60/796 |
| 2016/0326905 | A1 * | 11/2016 | Zhang | F02C 7/222 |

FOREIGN PATENT DOCUMENTS

| | | | | |
|---|---|---|---|---|
| JP | 2012233485 | A * | 11/2012 | F01D 25/12 |
| JP | 2012233485 | A | 11/2012 | |
| JP | 2014156813 | A | 8/2014 | |
| JP | 2014156813 | A * | 8/2014 | |
| JP | 6185177 | B2 | 8/2017 | |
| KR | 101766112 | B1 | 8/2017 | |
| KR | 101821503 | B1 | 1/2018 | |
| KR | 101828637 | B1 | 2/2018 | |
| KR | 1020190106291 | A | 9/2019 | |
| KR | 2020190002250 | U | 9/2019 | |
| KR | 102032728 | B1 | 10/2019 | |
| KR | 20190129569 | A | 11/2019 | |
| KR | 102062594 | B1 | 12/2019 | |
| WO | 2015069453 | A1 | 5/2015 | |
| WO | 2015103751 | A1 | 7/2015 | |

OTHER PUBLICATIONS

Written Opinion for KR 10-2020-0117167 dated Jan. 4, 2022 (Year: 2022).*

Request for the Submission of an Opinion for KR 10-2020-0143684 dated Mar. 30, 2022 (Year: 2022).*

Written Opinion for KR 10-2020-0143684 dated May 4, 2022 (Year: 2022).*

Notice of Reasons for Refusal dated Sep. 12, 2022 in the corresponding JPO Application 2021-114938 (Year: 2022).*

Ringfeder. Stiffness and Damping: This is what Engineers have to Consider when Tuning a Coupling. Jul. 20, 2016. https://blog.ringfeder.com/stiffness-and-damping-what-engineers-have-to-consider-when-tuning-a-coupling (Year: 2016).*

Fu, H. Teaching the Difference Between Stiffness and Damping. IEEE Control Systems Magazine. Aug. 2012. pp. 95-97. Accessed from https://hfu.mech.utah.edu/wp-content/uploads/sites/23/2016/06/FuHC_2012a-Teaching-the-difference-between-stiffness-and-damping.pdf (Year: 2012).*

English translation of Notice of Reasons for Refusal dated Sep. 20, 2022 in the corresponding JPO Application 2021-114938 (Year: 2022).*

EESR dated Feb. 23, 2022.

JP Office Action, dated Sep. 20, 2022.

* cited by examiner

VIBRATION DAMPER, EXHAUST DIFFUSER SYSTEM, AND GAS TURBINE INCLUDING SAME

CROSS REFERENCE TO RELATED APPLICATIONS

This application claims priority to Korean Patent Application Nos. 10-2020-0117167, filed on Sep. 11, 2020 and 10-2020-0143684, filed on Oct. 30, 2020, the disclosures of which are incorporated herein by reference in their entireties.

BACKGROUND

1. Field

Apparatuses and methods consistent with exemplary embodiments relate to a vibration damper for damping vibrations, an exhaust diffuser system including the vibration damper, and a gas turbine including the exhaust diffuser system.

2. Description of the Related Art

A gas turbine is a combustion engine in which a mixture of air compressed by a compressor and fuel is combusted to produce a high temperature gas that drives a turbine. The gas turbine is used to drive electric generators, aircraft, ships, trains, or the like.

With prolonged use, the function of the gas turbine deteriorates, resulting in reduced strength and increased abnormal vibration of the casing. For example, much vibration may occur in an exhaust diffuser from which combustion gas is discharged in a turbine.

SUMMARY

Aspects of one or more exemplary embodiments provide a vibration damper capable of damping vibrations occurring from a turbine casing, an exhaust diffuser system including the vibration damper, and a gas turbine including the exhaust diffuser system.

Additional aspects will be set forth in part in the description which follows and, in part, will become apparent from the description, or may be learned by practice of the exemplary embodiments.

According to an aspect of an exemplary embodiment, there is provided a vibration damper installed on an outer casing of a gas turbine to damp vibrations generated in the gas turbine, the vibration damper including: a reinforcing support part including a plurality of reinforcing plates; a first flange coupled to both longitudinal ends of the reinforcing support part and fixed to a protruding support protruding from the outer casing; and a second flange disposed between the plurality of reinforcing plates to connect the plurality of reinforcing plates, wherein each of the plurality of reinforcing plates is erected and installed on an outer circumferential surface of the outer casing.

The plurality of reinforcing plates may be formed in an arc-shape.

The plurality of reinforcing plates may be arranged in parallel, and the first flange may be fixed to both longitudinal end sides of the plurality of reinforcing plates.

Two second flanges may be disposed to face each other and may be fixed to each other by a fastener.

A shim plate may be disposed between the second flanges to separate the second flanges.

The shim plate may be formed of a material having elasticity.

The shim plate may be formed of a metal.

The shim plate may include a slit into which the fastener is fitted.

The first flange may be installed on the protruding support by a sliding block while supporting the sliding block so as to be slidable in a radial direction of the outer casing.

The sliding block may include a side plate and a cover plate bent from an end of the side plate and extending parallel to the first flange, wherein the cover plate includes a long hole, and the first flange is provided with a guide pin passing through the long hole.

According to an aspect of another exemplary embodiment, there is provided an exhaust diffuser system of a gas turbine including: an outer casing and an inner casing defining an exhaust space; a plurality of struts connecting the outer casing and the inner casing; a plurality of protruding supports protruding outward from the outer casing; and a vibration damper installed on the outer casing to damp vibrations generated in a gas turbine, wherein the vibration damper includes: a reinforcing support part including a plurality of reinforcing plates, and a first flange coupled to both longitudinal ends of the reinforcing support part, wherein the plurality of reinforcing plates are fixed to the plurality of protruding supports so as to be erected on an outer circumferential surface of the outer casing.

Each of the plurality of struts may be fixed to an inner side of an associated one of the plurality of protruding supports.

Each of the plurality of reinforcing plates may include an arc-shaped central support portion and an outer support portion formed on both longitudinal end sides of the central support portion and having a height gradually decreasing toward a distal side.

The vibration damper may further include a second flange disposed between the plurality of reinforcing plates to connect the plurality of reinforcing plates, wherein two second flanges are disposed to face each other, and a shim plate is disposed between the second flanges to separate the second flanges, wherein the shim plate includes a slit into which a fastener is fitted.

The first flange may be installed on the protruding support by a sliding block while supporting the sliding block so as to be slidable in a radial direction of the outer casing.

The sliding block may include a side plate and a cover plate bent from an end of the side plate and extending parallel to the first flange, wherein the cover plate includes a long hole, and the first flange is provided with a guide pin passing through the long hole.

According to an aspect of another exemplary embodiment, there is provided a gas turbine including: a compressor configured to compress air introduced from an outside, a combustor configured to mix the air compressed by the compressor with fuel and combust an air-fuel mixture to produce high-temperature and high-pressure combustion gas, a turbine having a plurality of turbine blades rotating by the combustion gas produced by the combustor, and an exhaust diffuser system disposed on a rear side of the turbine to discharge gas, wherein the exhaust diffuser system includes: an outer casing and an inner casing defining an exhaust space; a plurality of struts connecting the outer casing and the inner casing; a plurality of protruding supports protruding outward from the outer casing; and a vibration damper installed on the outer casing to damp vibrations generated in a gas turbine, wherein the vibration damper includes: a reinforcing support part including a plurality of reinforcing plates, and a first flange coupled to both longitudinal ends of the reinforcing support part, wherein the plurality of reinforcing plates are fixed to the plurality of protruding supports so as to be erected on an outer circumferential surface of the outer casing.

Each of the plurality of struts may be fixed to an inner side of the protruding support.

The vibration damper may further include a second flange disposed between the plurality of reinforcing plates to connect the plurality of reinforcing plates, wherein two second flanges are disposed to face each other, and a shim plate is disposed between the second flanges to separate the second flanges, wherein the shim plate includes a slit into which a fastener is fitted.

The first flange may be installed on the protruding support by a sliding block while supporting the sliding block so as to be slidable in a radial direction of the outer casing, and the sliding block may include a side plate and a cover plate bent from an end of the side plate and extending parallel to the first flange, wherein the cover plate includes a long hole, and the first flange is provided with a guide pin passing through the long hole.

According to one or more exemplary embodiments, the vibration damper has an effect of reducing abnormal vibrations generated in a gas turbine and improving the strength of the turbine casing. In addition, because the exhaust diffuser system includes the strut, the protruding support, and the vibration damper, it is possible to reduce the abnormal vibration generated in the diffuser of the gas turbine and improve the strength of the turbine casing.

BRIEF DESCRIPTION OF THE DRAWINGS

The above and other aspects will become more apparent from the following description of the exemplary embodiments with reference to the accompanying drawings, in which.

DETAILED DESCRIPTION

Figure 1:
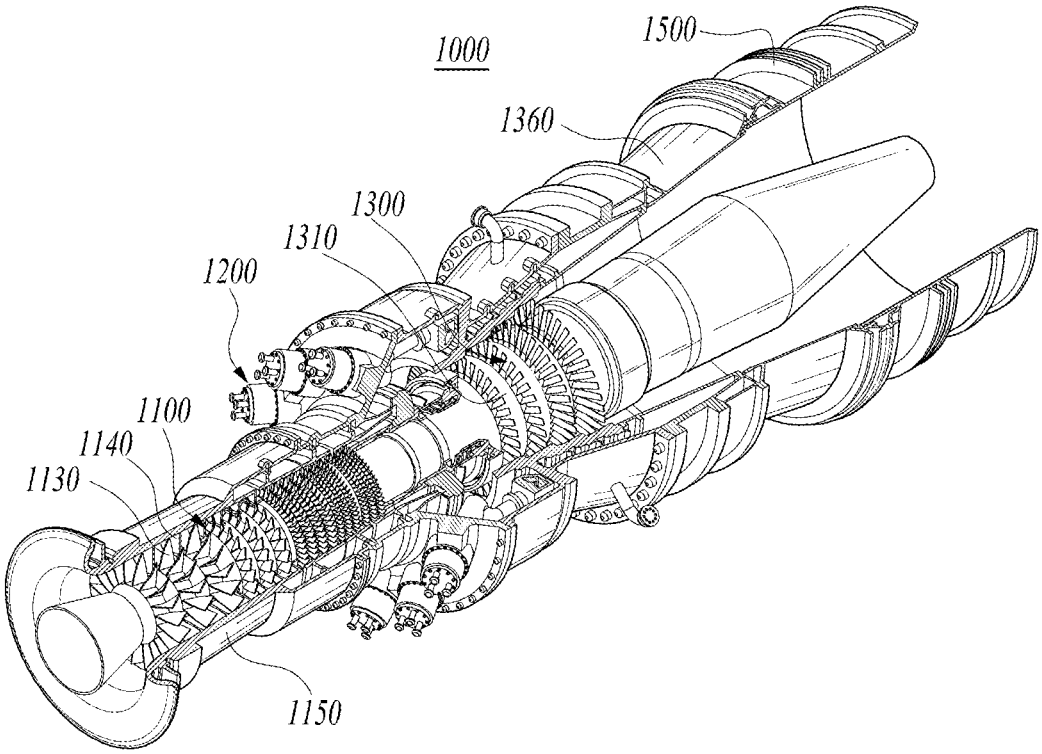
FIG. 1 is a view illustrating an interior of a gas turbine according to a first exemplary embodiment.

Various modifications and various embodiments will be described in detail with reference to the accompanying drawings. However, it should be noted that various embodiments are not limiting the scope of the disclosure to the specific embodiment, and they should be interpreted to include all modifications, equivalents, or substitutions of the embodiments included within the spirit and scope disclosed herein.

Terms used herein are used to merely describe specific embodiments, and are not intended to limit the scope of the disclosure. As used herein, an element expressed as a singular form includes a plurality of elements, unless the context clearly indicates otherwise. Further, it will be understood that the term "comprising" or "including" specifies the presence of stated features, numbers, steps, operations, elements, parts, or combinations thereof, but does not preclude the presence or addition of one or more other features, numbers, steps, operations, elements, parts, or combinations thereof.

Hereinafter, exemplary embodiments will be described in detail with reference to the accompanying drawings. It is noted that like reference numerals refer to like parts throughout the various figures and exemplary embodiments. In certain embodiments, the detailed description of known functions and configurations that may obscure the gist of the present disclosure will be omitted. For the same reason, some of the elements in the drawings are exaggerated, omitted, or schematically illustrated.

Hereinafter, a gas turbine according to a first exemplary embodiment will be described with reference to the accompanying drawings.

Figure 2:
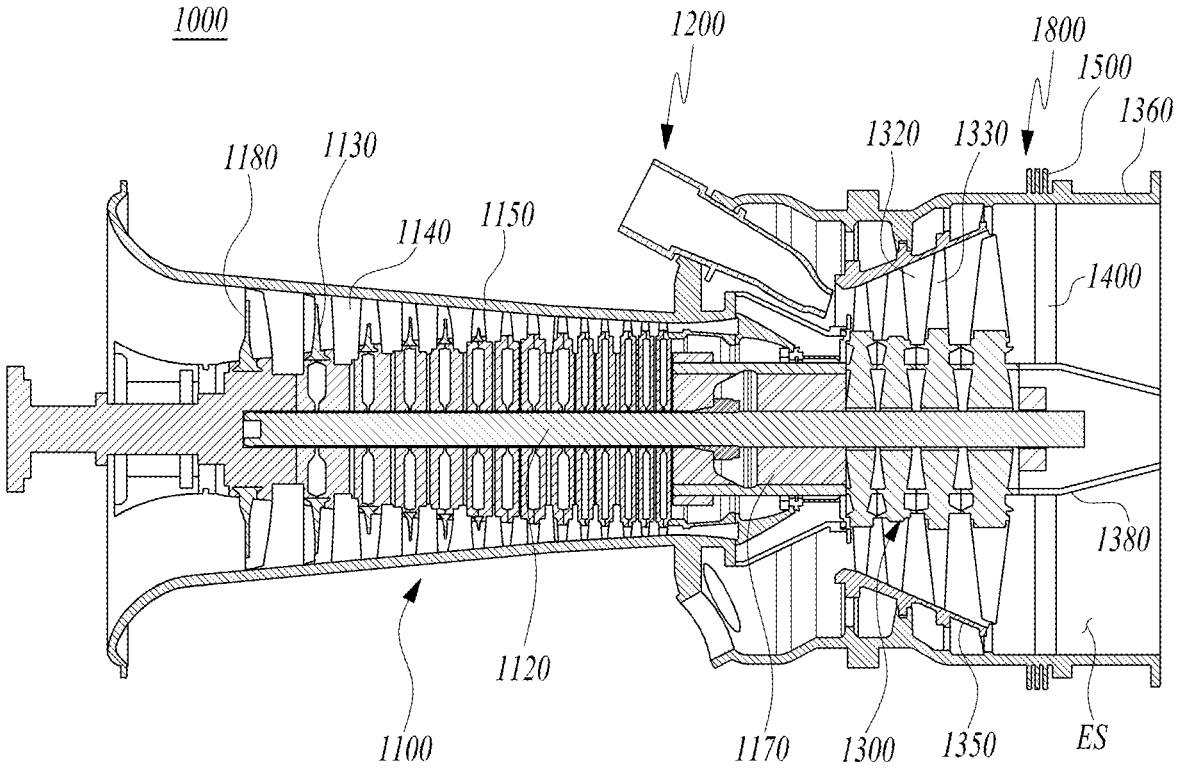
FIG. 2 is a longitudinal cross-sectional view illustrating a part of the gas turbine of FIG. 1.

FIG. 1 is a view illustrating an interior of a gas turbine according to an exemplary embodiment, and FIG. 2 is a longitudinal cross-sectional view of the gas turbine of FIG. 1.

Referring to FIGS. 1 and 2, an ideal thermodynamic cycle of a gas turbine 1000 may comply with the Brayton cycle. The Brayton cycle consists of four thermodynamic processes: an isentropic compression (i.e., an adiabatic compression) process, an isobaric combustion process, an isentropic expansion (i.e., an adiabatic expansion) process, and isobaric heat ejection process. That is, in the Brayton cycle, thermal energy may be released by combustion of fuel in an isobaric environment after atmospheric air is sucked and compressed into high pressure air, hot combustion gas may be expanded to be converted into kinetic energy, and exhaust gas with residual energy may be discharged to the outside. As such, the Brayton cycle consists of four thermodynamic processes: compression, heating, expansion, and exhaust.

The gas turbine 1000 employing the Brayton cycle includes a compressor 1100, a combustor 1200, a turbine 1300, and an exhaust diffuser system 1800. Although the following description will be described with reference to FIG. 1, the present disclosure may be widely applied to other turbine engines similar to the gas turbine 1000 illustrated in FIG. 1.

Referring to FIG. 1, the compressor 1100 may suck and compress air. The compressor 1100 may supply the compressed air by compressor blades 1130 to a combustor 1200 and also supply cooling air to a high temperature region of the gas turbine 1000. Here, because the sucked air is compressed in the compressor 1100 through an adiabatic compression process, the pressure and temperature of the air passing through the compressor 1100 increases.

The compressor 1100 may be designed in the form of a centrifugal compressor or an axial compressor, wherein the centrifugal compressor is applied to a small-scale gas turbine, whereas a multi-stage axial compressor is applied to a large-scale gas turbine 1000 illustrated in FIG. 1 to compress a large amount of air. In the multi-stage axial compressor 1100, the compressor blades 1130 rotate according to the rotation of a central tie rod 1120 and rotor disks, compress the introduced air and move the compressed air to the compressor vane 1140 disposed at a following stage. The air is compressed gradually to a high pressure while passing through the compressor blades 1130 formed in multiple stages.

The compressor vanes 1140 are mounted inside a housing 1150 in such a way that a plurality of compressor vanes 1140 form each stage. The compressor vanes 1140 guide the compressed air moved from the compressor blade 1130 disposed at a preceding stage toward the compressor blade 1130 disposed at a following stage. For example, at least some of the compressor vanes 1140 may be mounted so as to be rotatable within a predetermined range, e.g., to adjust an air inflow. In addition, guide vanes 1180 may be provided in the compressor 1100 to control a flow rate of air introduced into the compressor 1100.

The compressor 1100 may be driven using a portion of the power output from the turbine 1300. To this end, as illustrated in FIG. 1, a rotary shaft of the compressor 1100 and a rotary shaft of the turbine 1300 may be directly connected by a torque tube 1170. In the case of the large-scale gas turbine 1000, almost half of the output produced by the turbine 1300 may be consumed to drive the compressor 1100.

The combustor 1200 may mix compressed air supplied from an outlet of the compressor 1100 with fuel and combust the air-fuel mixture at a constant pressure to produce a high-energy combustion gas. That is, the combustor 1200 mixes the compressed air with fuel, combusts the mixture to produce a high-temperature and high-pressure combustion gas with high energy, and increases the temperature of the combustion gas, through an isobaric combustion process, to a temperature at which the combustor and turbine parts can withstand without being thermally damaged.

The combustor 1200 may include a plurality of burners arranged in a housing formed in a cell shape and having a fuel injection nozzle, a combustor liner forming a combustion chamber, and a transition piece as a connection between the combustor and the turbine.

The high-temperature and high-pressure combustion gas ejected from the combustor 1200 is supplied to the turbine 1300. As the supplied high-temperature and high-pressure combustion gas expands, impulse and impact forces are applied to the turbine blades 1330 to generate rotational torque. A portion of the rotational torque is transferred to the compressor 1100 through the torque tube 1170, and remaining portion which is an excessive torque is used to drive a generator, or the like.

The turbine 1300 includes a rotor disk 1310, a plurality of turbine blades 1330 and turbine vanes 1320 arranged radially on the rotor disk 1310, and a ring segment 1350 disposed around the turbine blades 1330. The rotor disk 1310 has a substantially disk shape, and a plurality of grooves are formed in an outer circumferential portion thereof. The grooves are formed to have a curved surface so that the turbine blades 1330 are inserted into the grooves, and the turbine vanes 1320 are mounted in a turbine casing. The turbine blades 1330 may be coupled to the rotor disk 1310 in a manner such as a dovetail connection. The turbine vanes 1320 are fixed so as not to rotate and guide a flow direction of the combustion gas passing through the turbine blades 1330. The ring segment 1350 may be provided around the turbine blades 1330 to maintain a sealing function. A plurality of ring segments 1350 may be disposed circumferentially around the turbine 1300 to form a ring assembly.

The exhaust diffuser system 1800 is installed on a rear side of the gas turbine 1000 and discharges combustion gas discharged from the turbine 1300. The exhaust diffuser system 1800 may include an outer casing 1360, an inner casing 1380, a strut 1400, a protruding support 1365, and a vibration damper 1500.

The outer casing 1360 has a cylindrical shape that forms an external contour and prevents leakage of gas. The outer casing 1360 may have a circular longitudinal section. The outer casing 1360 surrounds the compressor 1100 and the turbine 1300, and forms an exhaust space ES on a rear side of the turbine 1300. The outer casing 1360 may be formed such that an inner diameter gradually increases toward the rear side.

The inner casing 1380 is spaced apart from the outer casing 1360 to form an annular exhaust space ES, and may be formed in a conical shape with an inner diameter gradually decreasing toward the rear side. Accordingly, cross-sectional area of the exhaust space ES may gradually increase toward the rear side.

A plurality of protruding supports 1365 are formed on an outer circumferential surface of the outer casing 1360, and may be spaced apart from each other in the circumferential direction of the outer casing 1360. However, the present disclosure is not limited thereto, and the protruding support may protrude from an inner circumferential surface of the outer casing. The protruding support 1365 may be formed in a substantially T-shape.

The strut 1400 is fixed to the inner side of the protruding support 1365 to connect the outer casing 1360 and the inner casing 1380. A plurality of struts 1400 may be spaced apart from each other in the circumferential direction of the turbine 1300. The strut 1400 damps the vibration generated in the outer casing 1360 together with the inner casing 1380.

Figure 3:
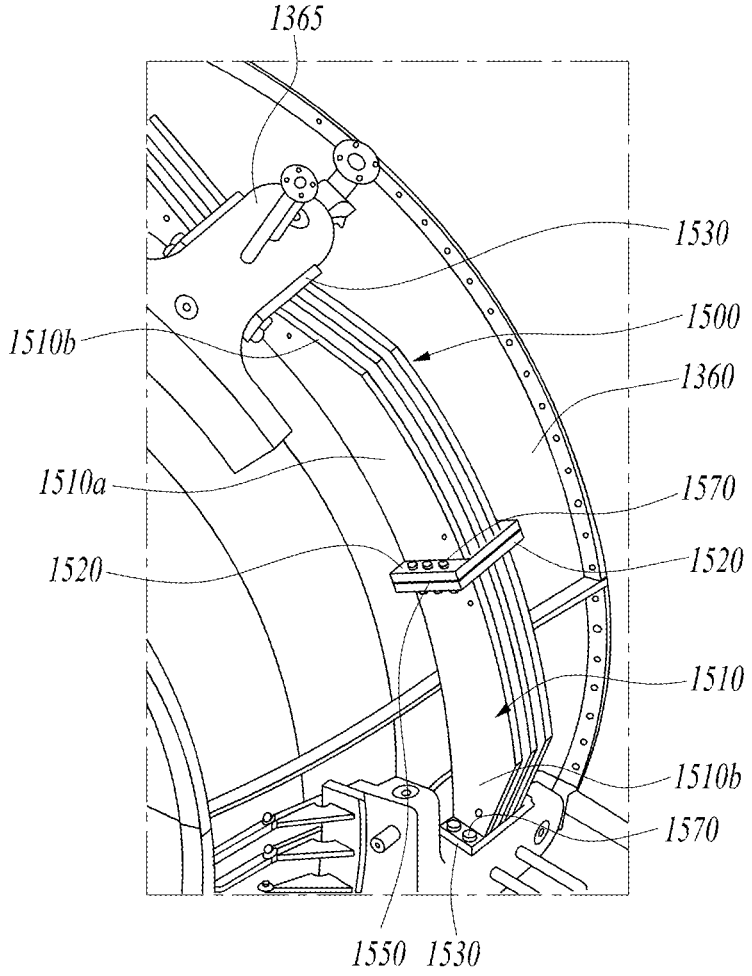
FIG. 3 is an enlarged view illustrating a state in which a vibration damper according to the first exemplary embodiment is installed.
Figure 4:
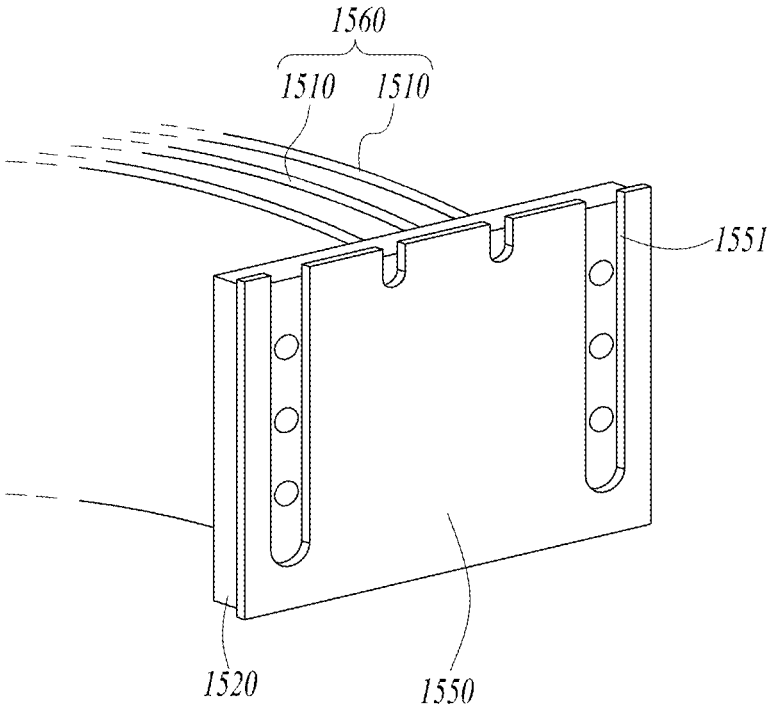
FIG. 4 is a perspective view illustrating a part of the vibration damper according to the first exemplary embodiment.

FIG. 3 is an enlarged view illustrating a state in which a vibration damper according to the first exemplary embodiment is installed, and FIG. 4 is a perspective view illustrating a part of the vibration damper according to the first exemplary embodiment.

Referring to FIGS. 3 and 4, the vibration damper 1500 includes a reinforcing support part 1560 including a plurality of reinforcing plates 1510, a first flange 1530 coupled to both longitudinal ends of the reinforcing support part 1560 so as to be fixed to the protruding support 1365 protruding from the outer circumferential surface of the outer casing 1360, a second flange 1520 disposed between the reinforcing plates 1510 to connect the reinforcing plates 1510, and a shim plate 1550 that contacts and supports the first flange 1530 and the second flange 1520.

The reinforcing support part 1560 includes the plurality of reinforcing plates 1510 disposed to face each other. The reinforcing support part 1560 may circumferentially support the outer casing 1360 to prevent the outer casing 1360 from shaking.

In addition, the reinforcing plates 1510 may be spaced apart in the longitudinal direction with the second flange 1520 interposed therebetween. The reinforcing plates 1510 are formed in an arc shape, and may be erected and installed with respect to the outer circumferential surface of the outer casing 1360. However, the present disclosure is not limited thereto, and the vibration damper 1500 may be fixed to the inner circumferential surface of the outer casing 1360.

The reinforcing plate 1510 may include an arc-shaped central support portion 1510*a* and outer support portions

1510*b* formed on both longitudinal end sides of the central support portion 1510*a* and having a height gradually decreasing toward a distal end side. If the reinforcing plate 1510 includes the central support portion 1510*a* and the outer support portions 1510*b*, vibration may be more efficiently reduced. In addition, an inner surface of the reinforcing plate 1510 may be spaced apart from the outer surface of the outer casing 1360.

The vibration damper 1500 may be fixed to the outer casing 1360 at a portion in which the turbine 1300 is located, and e.g., may be installed in an exhaust region in which gas is discharged from the turbine 1300.

The first flange 1530 is erected perpendicular to a longitudinal end of the reinforcing plate 1510 and may be fixed to the protruding support 1365 by a fastener 1570. For example, the fastener 1570 may be formed of a bolt. The shim plate 1550 may be installed between the first flange 1530 and the protruding support 1365.

The second flange 1520 is disposed between the reinforcing plates 1510 to connect the reinforcing plates 1510, and two adjacent second flanges 1520 are disposed to face each other and are fixed by a fastener 1570. The second flange 1520 may be vertically fixed to the longitudinal end of the reinforcing plate 1510 to connect the reinforcing plates 1510.

The shim plate 1550 is installed between the second flanges 1520. Here, a plurality of shim plates 1550 may be installed depending on a distance between the second flanges 1520. The shim plate 1550 may be formed of elastic rubber, silicone, or the like. Accordingly, vibration characteristics of the outer casing 1360 may be improved by the shim plate 1550. In addition, the shim plate 1550 may be formed of a metal such as carbon steel, stainless steel, or the like.

Two slits 1551 are formed in the shim plate 1550, and a plurality of fasteners 1570 may be inserted into the slits 1551. Accordingly, the shim plate 1550 may be easily assembled and disassembled using the slits 1551 without completely removing the fasteners 1570 from the first flange 1530 and the second flange 1520. When the shim plate 1550 is assembled, an installation error may be corrected, and vibration characteristics of the outer casing 1360 may be improved by the shim plate 1550.

The shim plate 1550 assembled between the first flanges 1530 and the shim plate 1550 assembled between the second flanges 1520 may be formed of different materials. For example, the shim plate 1550 assembled between the first flanges 1530 may be formed of a material having elasticity, and the shim plate assembled between the second flanges 1520 may be formed of metal.

When the shim plate 1550 is installed so as to abut against the first flange 1530 and the second flange 1520, vibration can be damped from the outside and inside of the vibration damper 1500, thereby improving the vibration damping performance.

Figure 5:
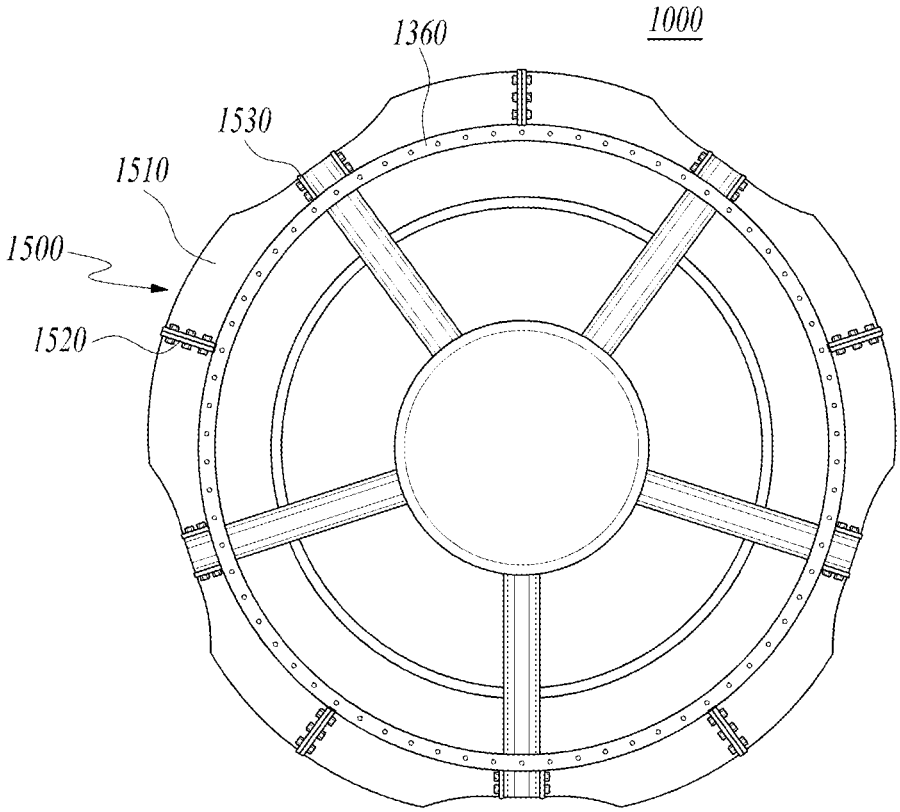
FIG. 5 is a bottom view illustrating the gas turbine according to the first exemplary embodiment.
Figure 6:
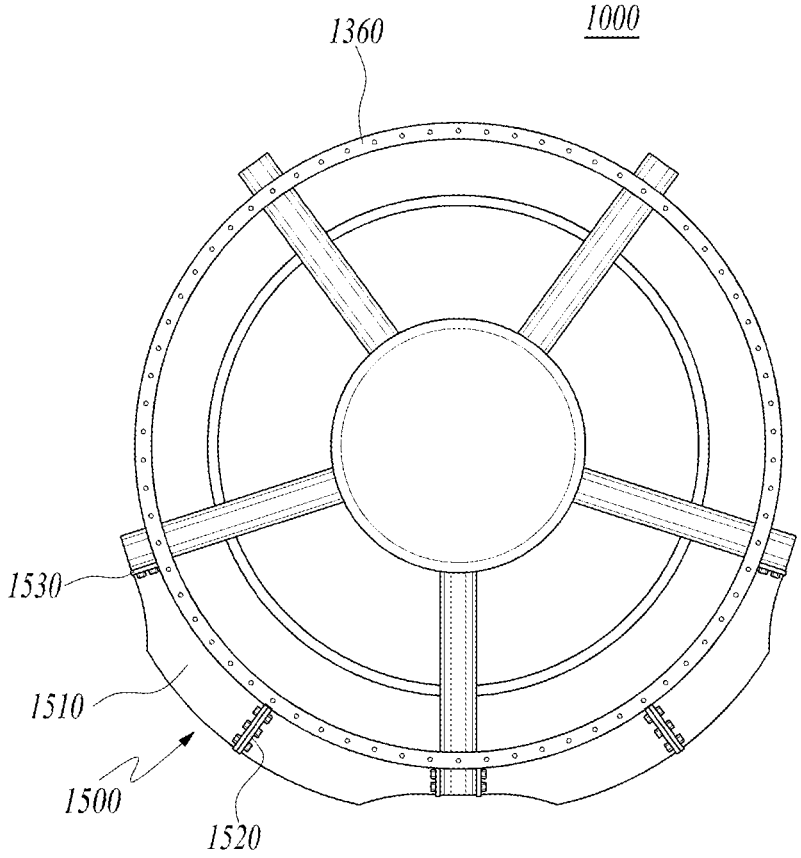
FIG. 6 is a bottom view illustrating a gas turbine according to a modification of the first exemplary embodiment.

FIG. 5 is a bottom view illustrating the gas turbine according to the first exemplary embodiment, and FIG. 6 is a bottom view illustrating a gas turbine according to a modification of the first exemplary embodiment.

Referring to FIG. 5, the vibration damper 1500 may be arranged around the entire circumference of the outer casing 1360 to surround the outer casing 1360. Alternatively, the vibration damper 1500 may be installed only on a part of the outer casing 1360.

If the vibration damper 1500 is installed as in the first exemplary embodiment, the structural strength of the outer casing 1360 may be improved, and the vibration characteristics of the outer casing 1360 may also be improved. For example, at the outlet side of the turbine 1300, vibration may increase due to deterioration of the turbine 1300, and the vibration damper 1500 may significantly reduce vibration occurring due to the deterioration of the turbine 1300. In addition, the vibration damper 1500 may be connected to the inner casing 1380 via the protruding support 1365 and the strut 1400 to more effectively reduce the vibration of the outer casing 1360.

Figure 7:
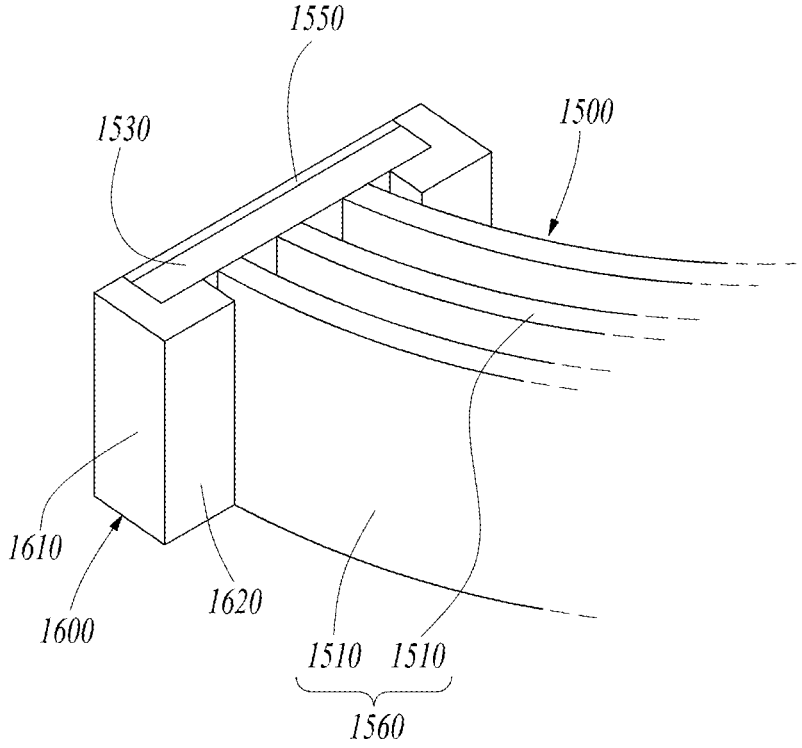
FIG. 7 is a view illustrating a state in which a vibration damper is installed in the gas turbine according to a second exemplary embodiment.

Hereinafter, a gas turbine according to a second exemplary embodiment will be described. FIG. 7 is a view illustrating a state in which a vibration damper is installed in the gas turbine according to a second exemplary embodiment.

Referring to FIG. 7, the gas turbine according to the second exemplary embodiment has the same structure as the gas turbine according to the first exemplary embodiment except for sliding block 1600, so a redundant description of the same configuration will be omitted.

The vibration damper 1500 according to the second exemplary embodiment may further include a sliding block 1600 supporting the first flange 1530. The first flange 1530 may be fixed to the outer casing 1360 through the sliding block 1600. The sliding block 1600 includes side plates 1610 abutting against sides of the first flange 1530 and cover plates 1620 bent from the side plates 1610 and extending parallel to the first flange 1530, and the first flange 1530 is inserted into grooves defined by the side plates 1610 and the cover plates 1620. The sliding block 1600 supports the first flange 1530 to be slidable in the radial direction of the outer casing 1360. Although the sliding block 1600 may have a structure in which the outer end side is open in FIG. 7, the present disclosure is not limited thereto, and the sliding block 1600 may have various structures having a groove through which the first flange 1530 moves.

When the sliding block 1600 is installed as in the second exemplary embodiment, if the outer casing 1360 expands due to heat, the vibration damper 1500 may be pushed outward, and if the outer casing 1360 is cooled and contracts, the vibration damper 1500 may be moved inward.

Figure 8:
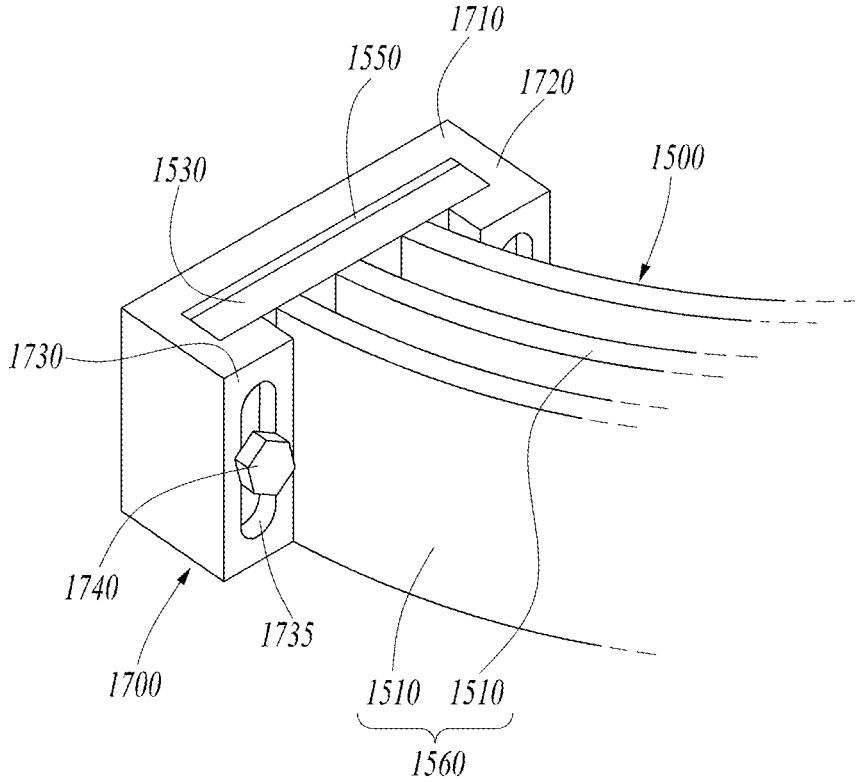
FIG. 8 is a view illustrating a state in which a vibration damper is installed in the gas turbine according to a third exemplary embodiment.

Hereinafter, a gas turbine according to a third exemplary embodiment will be described. FIG. 8 is a view illustrating a state in which a vibration damper is installed in the gas turbine according to a third exemplary embodiment.

Referring to FIG. 8, the gas turbine according to the third exemplary embodiment has the same structure as the gas turbine according to the first exemplary embodiment except for a sliding block 1700, so a redundant description of the same configuration will be omitted.

The first flange 1530 may be fixed to the outer casing 1360 via the sliding block 1700. The sliding block 1700 includes a base plate 1710 abutting against the protruding support 1365, side plates 1720 protruding from both ends of the base plate 1710, and cover plates 1730 bent from ends of the side plates 1720. The first flange 1530 is inserted into grooves defined by the base plate 1710, the side plates 1720, and the cover plates 1730. The cover plates 1730 extend parallel to the first flange 1530 to surround the first flange 1530 to prevent the first flange 1530 from being detached. The shim plate 1550 may be disposed between the base plate 1710 and the first flange 1530.

A long hole 1735 extending in a height direction of the cover plate 1730 is formed in the cover plate 1730, and a guide pin 1740 is provided on the first flange 1530 to pass through the long hole 1735. Accordingly, the first flange 1530 may be easily slidable in the radial direction of the outer casing 1360 by being guided by the long hole 1735 and the guide pin 1740.

Figure 9:
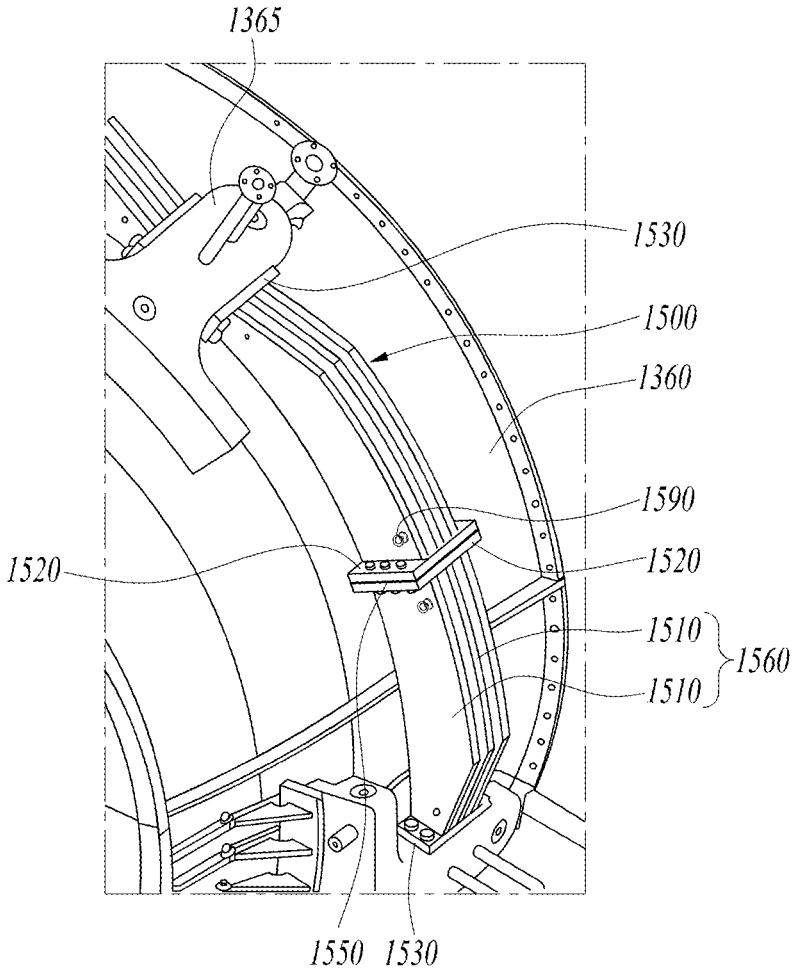
FIG. 9 is an enlarged view illustrating a state in which a vibration damper according to a fourth exemplary embodiment is installed.

Hereinafter, a gas turbine according to a fourth exemplary embodiment will be described. FIG. 9 is an enlarged view illustrating a state in which a vibration damper according to a fourth exemplary embodiment is installed.

Referring to FIG. 9, the gas turbine according to the fourth exemplary embodiment has the same structure as the gas turbine according to the first exemplary embodiment, except for ring jig 1590, so a redundant description of the same configuration will be omitted.

The ring jig 1590 may be installed on the reinforcing plate 1510. When installing the ring jig 1590, the vibration damper 1500 may be easily installed by connecting a cable to the ring jig 1590. In addition, the outer casing 1360 may be lifted through the vibration damper 1500 by connecting the cable to the ring jig 1590.

While one or more exemplary embodiments have been described with reference to the accompanying drawings, it will be apparent to those skilled in the art that various modifications and variations can be made through addition, change, omission, or substitution of components without departing from the spirit and scope of the disclosure as set forth in the appended claims, and these modifications and changes fall within the spirit and scope of the disclosure as defined in the appended claims.

What is claimed is:

1. A vibration damper installed on an outer casing of a gas turbine to damp vibrations generated in the gas turbine, the vibration damper comprising:
- a reinforcing support part comprising a plurality of reinforcing plates;
- a pair of first flanges, each first flange coupled to either one of two longitudinal ends of the reinforcing support part and fixed to a protruding support protruding from the outer casing; and
- two second flanges disposed between the plurality of reinforcing plates to connect the plurality of reinforcing plates,
- wherein each of the plurality of reinforcing plates is erected and installed on an outer circumferential surface of the outer casing,
- wherein the two second flanges are disposed to face each other and are fixed to each other by a fastener.

2. The vibration damper according to claim 1, wherein each of the plurality of reinforcing plates is formed in an arc-shape.

3. The vibration damper according to claim 1, wherein the plurality of reinforcing plates are arranged in parallel, and the pair of first flanges is fixed to both longitudinal end sides of the plurality of reinforcing plates.

4. The vibration damper according to claim 1, wherein a shim plate is disposed between the second flanges to separate the second flanges.

5. The vibration damper according to claim 4, wherein the shim plate is formed of a material having elasticity.

6. The vibration damper according to claim 4, wherein the shim plate is formed of a metal.

7. The vibration damper according to claim 4, wherein the shim plate includes a slit into which the fastener is fitted.

8. The vibration damper according to claim 1, wherein each first flange is installed on the protruding support by a sliding block while supporting the sliding block so as to be slidable in a radial direction of the outer casing.

9. The vibration damper according to claim 8, wherein the sliding block comprises a side plate and a cover plate bent from an end of the side plate and extending parallel to each first flange,
- wherein the cover plate includes a slot, and each first flange is provided with a guide pin passing through the slot.

10. An exhaust diffuser system for a gas turbine, the system comprising:
- an outer casing and an inner casing defining an exhaust space;
- a plurality of struts connecting the outer casing and the inner casing;
- a plurality of protruding supports protruding outward from the outer casing; and
- a vibration damper installed on the outer casing to damp vibrations generated in a gas turbine,
- wherein the vibration damper comprises:
- a reinforcing support part comprising a plurality of reinforcing plates; and
- a pair of first flanges, each first flange coupled to either one of two longitudinal ends of the reinforcing support part,
- wherein the plurality of reinforcing plates are fixed to the plurality of protruding supports so as to be erected on an outer circumferential surface of the outer casing,
- wherein the vibration damper further comprises two second flanges disposed between the plurality of reinforcing plates to connect the plurality of reinforcing plates.

11. The exhaust diffuser system according to claim 10, wherein each of the plurality of struts is fixed to an inner side of an associated one of the plurality of protruding supports.

12. The exhaust diffuser system according to claim 10, wherein each of the plurality of reinforcing plates comprises an arc-shaped central support portion and an outer support portion formed on both longitudinal end sides of the central support portion and having a height gradually decreasing toward a distal side.

13. The exhaust diffuser system according to claim 10,
- wherein the two second flanges are disposed to face each other, and a shim plate is disposed between the second flanges to separate the second flanges, and
- wherein the shim plate includes a slit into which a fastener is fitted.

14. The exhaust diffuser system according to claim 10, wherein each first flange is installed on an associated one of the plurality of protruding supports by a sliding block while supporting the sliding block so as to be slidable in a radial direction of the outer casing.

15. The exhaust diffuser system according to claim 14, wherein the sliding block comprises a side plate and a cover plate bent from an end of the side plate and extending parallel to each first flange,
- wherein the cover plate includes a slot, and each first flange is provided with a guide pin passing through the slot.

16. A gas turbine comprising:
- a compressor configured to compress air introduced from an outside,
- a combustor configured to mix the air compressed by the compressor with fuel and combust an air-fuel mixture to produce high-temperature and high-pressure combustion gas,
- a turbine having a plurality of turbine blades rotating by the combustion gas produced by the combustor, and
- an exhaust diffuser system disposed on a rear side of the turbine to discharge gas, wherein the exhaust diffuser system comprises:

an outer casing and an inner casing defining an exhaust space;

a plurality of struts connecting the outer casing and the inner casing;

a plurality of protruding supports protruding outward from the outer casing; and a vibration damper installed on the outer casing to damp vibrations generated in a gas turbine, wherein the vibration damper comprises:

a reinforcing support part comprising a plurality of reinforcing plates; and a pair of first flanges, each first flange coupled to either one of two longitudinal ends of the reinforcing support part, wherein the plurality of reinforcing plates are fixed to the plurality of protruding supports so as to be erected on an outer circumferential surface of the outer casing.

17. The gas turbine according to claim 16, wherein each of the plurality of struts is fixed to an inner side of an associated one of the plurality of protruding supports.

18. The gas turbine according to claim 16, wherein the vibration damper further comprises two second flanges disposed between the plurality of reinforcing plates to connect the plurality of reinforcing plates, wherein the two second flanges are disposed to face each other, and a shim plate is disposed between the second flanges to separate the two second flanges, and wherein the shim plate includes a slit into which a fastener is fitted.

19. The gas turbine according to claim 16, wherein each first flange is installed on an associated one of the plurality of protruding supports by a sliding block while supporting the sliding block so as to be slidable in a radial direction of the outer casing, and the sliding block comprises a side plate and a cover plate bent from an end of the side plate and extending parallel to each first flange, wherein the cover plate includes a slot, and each first flange is provided with a guide pin passing through the slot.

20. The gas turbine according to claim 16, wherein the vibration damper further comprises two second flange disposed between the plurality of reinforcing plates to connect the plurality of reinforcing plates.

* * * * *